United States Patent [19]

Naemura

[11] 4,087,909

[45] May 9, 1978

[54] DRY SHAVER

[75] Inventor: Akio Naemura, Yamatokoriyama, Japan

[73] Assignee: Sharp Kabushiki Kaisha, Osaka, Japan

[21] Appl. No.: 273,457

[22] Filed: Jul. 20, 1972

[51] Int. Cl.[2] ..... B26B 9/14; B26B 9/04

[52] U.S. Cl. ..... 30/43.6

[58] Field of Search ..... 30/43.4, 43.5, 43.6, 30/346.51, 43, 43.1

[56] References Cited

U.S. PATENT DOCUMENTS

| | | | |
|---|---|---|---|
| 2,952,908 | 9/1960 | Starre | 30/43.5 |
| 3,069,772 | 12/1962 | Roessing | 30/43.1 X |
| 3,078,571 | 2/1963 | Timmerman | 30/346.51 X |
| 3,172,200 | 3/1965 | Ream | 30/43.1 |
| 3,242,569 | 3/1966 | Driest | 30/43.5 |
| 3,656,235 | 4/1972 | Zuurveen | 30/346.51 |
| 3,694,915 | 10/1972 | Beusink | 30/43.5 X |
| 3,715,803 | 2/1973 | Tyler | 30/43.5 |
| 3,844,033 | 10/1974 | Yonkers | 30/43.5 |

*Primary Examiner*—Gary L. Smith

*Attorney, Agent, or Firm*—Birch, Stewart, Kolasch and Birch

[57] ABSTRACT

A dry shaver comprising one or more pairs of shear plates having a comb shape and rotary blades in contact with the shear plates which slide on said shear plates while rotating. The rotary blades of each pair of shear plates are supported at only two points within the shaver case and rock or incline with the supporting points acting as fulcra, whereby a close fit to the curved surface of the skin is achieved.

19 Claims, 6 Drawing Figures

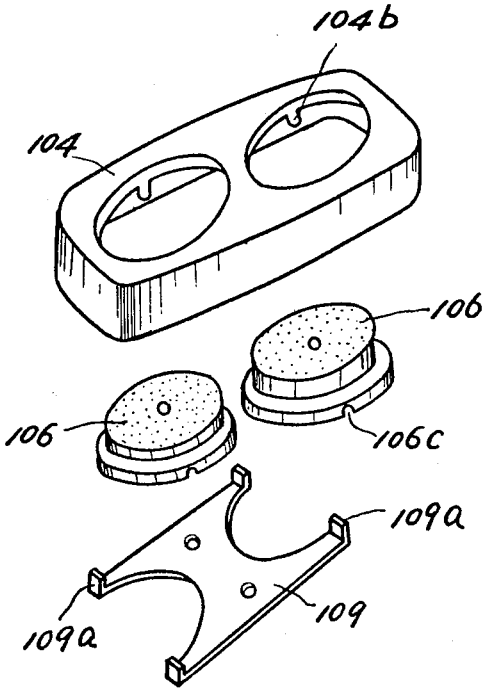
FIG. 5
FIG. 6
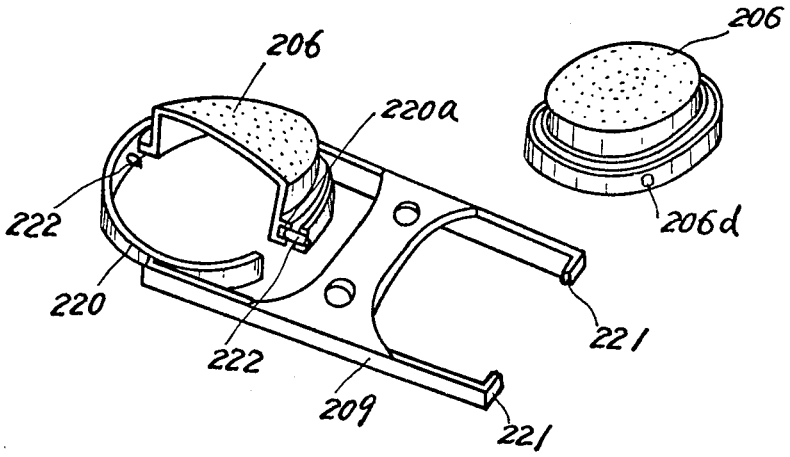

DRY SHAVER

BACKGROUND OF THE INVENTION

The present invention relates to a shaver of the so-called rotary type wherein rotary blades rotate in contact with a shear plate having a comb shape. More particularly, the present invention is directed to an improved rotary shaver so arranged and constructed that the rotary blades achieve a free rocking motion relative to the case during the shaving process.

As is commonly known the shear plate is fixed to the case. With this type of shaver, however, the shear plate does not fit the curved skin surface, very well resulting in a poor shaving efficiency, a difficulty in cutting the beards sufficiently short and also a long time required for shaving.

Another known type of dry shaver has rotary blades mounted on the drive shaft over a spring so as to be displaceable along its axis, with the shear plate mounted thereon and supported thereby. With this type of shaver, however, the external force to which the shear plate is subjected during shaving is directly transmitted to the rotary blades with a resultant increase in the friction between the shear plate and rotary blades, which, in turn, can cause a decrease of the revolution rate of the blades and, more critically, an adverse effects on the rotary blades-to-drive shaft coupling system.

OBJECTS AND SUMMARY OF THE INVENTION

A primary object of the present invention is to provide a dry shaver whose shear plate can rock or incline to fit the skin surface being shaved.

Another object of this invention is to provide a shaver of such construction that the outer shear plate is so attached to the case that it can rock freely.

A further object of the present invention is to provide a shaver wherein the rotary blade is fixed to the driving shaft with no play therebetween so that the compression force of the compression spring against the rotary blade and thus against the shear plate is parallel to the driving shaft and perpendicular to the shear plate at all times.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

The construction embodying the present invention with the shear plate movably supported by the case helps protect the rotary inner blades from the action of the external force to which the shear plate is directly subjected, the external force being transmitted to act only on the case. Thus an unnecessary increase of the friction between the shear plate and the rotary blades can be successfully prevented, thereby reducing the wear of both the shear plate and the rotary blades and precluding an adverse effect on the cutter-to-shaft coupling. The present invention is characterized by the shear plate supporting mechanism wherein the case is provided with two supporting points for the shear plate so that the shear plate can rock freely with said supporting points acting as a fulcra.

According to the present invention, it is also possible to provide the shear plate supporting mechanism wherein there is provided supporting members with two supporting points for the shear plate, and said supporting members, in turn, are mounted on the case to be supported thereby at two points apart from those on said supporting member so that the shear plate can rock or slant freely relative to the case.

A further feature of the present invention is a power transmitting mechanism which enables rotation of the blades sliding in contact with the shear plate. This may be accomplished, for example, by connecting the drive shaft to the power source over a universal joint and having the rotary blades mounted on the drive shaft so powered.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

FIG. 5 is a perspective view of the disassembled holder of another embodiment of the present invention showing two shear plates; and FIG. 6 is a sectional view showing the structure of the key parts of the holder in a further embodiment of the present invention.

DESCRIPTION OF THE PREFERRED EMBODIMENTS

Figure 1:
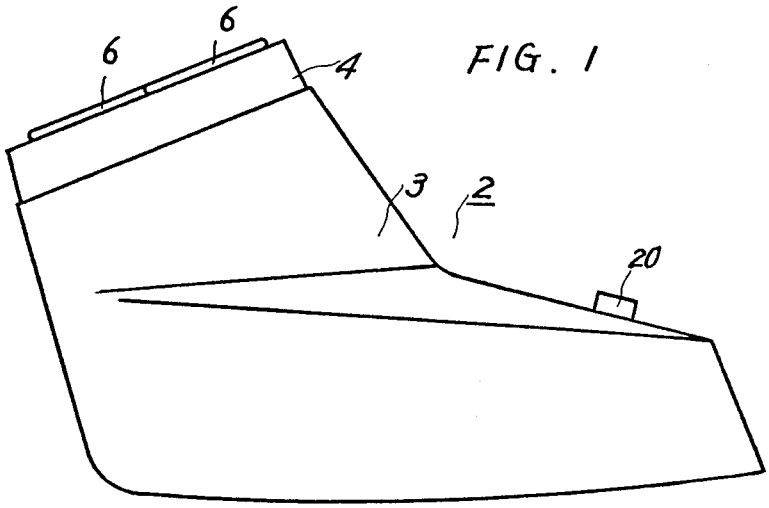
FIG. 1 is a diagram showing the external appearance of the dry shaver according to the present invention.

Referring now to the drawings, the case 2 housing the battery, motor 1 etc., is composed of a body 3 and a holder 4. The holder 4 has three circular openings 5, 5, 5 so arranged as to be positioned at the vertices of an equilateral triangle. Three circular shear plates 6, 6, 6 are movably set in the openings 5, 5, 5 with some play and rotary blades 7, 7, 7 are so mounted as to be freely rotatable in these circular shear plates 6.

The holder 4 has a supporting member 9 secured thereto with a screw 8 at the center on the back thereof. The supporting member 9 protruding partially into the openings 5, 5, 5 serves to prevent the rotary blade 7 for dropping out of the shear plate 6.

Each of the openings 5 is formed in two stages so that the holder 4 has an inward flange **4*a*, and, on the back of the flange 4*a*, a pair of projections 4*b*, 4*b*** are arranged symmetrically across the center.

The flange **6*a* of the shear plate 6 has on its topside a pair of recesses 6*b*, 6*b* arranged symmetrically across the center, the recesses receiving the above-mentioned projections 4*b*, 4*b*. Such fitting mechanism serves to prevent rotation of the shear plate 6 along the blade 7 and at this time allows rocking of the shear plate 6**.

The abovementioned supporting member 9 contains a pair of upward projections or edges **9*a*, 9*a* arranged point-symmetrically so as to support the flange 6*a* of the shear plate 6 or both sides from beneath. The projections 9*a*, 9*a* are positioned under the recesses 6*b*, 6*b***.

Hence, the shear plate 6 can rock with the projections 9*a*, 9*a* acting as fulcra.

The supporting projections 9*a*, 9*a* are so positioned that the vertical amplitude of the rocking motion of the shear plate 6 is maximum at a point nearest to or remotest from the center of the holder 4, i.e., they are so positioned as to support the shear plate 6 where symmetric across the center thereof and equidistant from the center of the holder 4.

More particularly, the supporting projections 9*a*, 9*a* are located on or close to a line passing the center of the shear plate 6 and perpendicular to the plane containing a line passing the center of the shear plate 6 and the center of the holder 4.

Recesses 4*c*, 4*c* are formed on the back of the holder 4 for positioning the supporting member 9, and for receiving a part of the projections 9*a*, 9*a* of the supporting member.

On the shaft of the motor 1 is mounted the driving gear 10 which is in mesh with the driven gear 11. The drive shaft 12 is connected to the driven shaft 11 over a universal joint to be described hereinafter, its rectangular tip 12*a* fitting in the rectangular hole 7*a* in the leg of the rotary blade 7.

The universal joint disclosed herein is not to be considered of a limiting nature in the light of the present invention, and thus various equivalent alternatives can be used. The flange 12*b* at the lower end of the drive shaft 12 has two sides parallel along its periphery and two convex sides bordering thereon. The abovementioned driven gear has, in its center, a bore 11*a* whose wall is similar to and a little larger than the peripheral surface of the flange 12*b*. Hence the flange 12*b* is fitted in the bore 11*a* with some play and thus the flange 12*b*, being rotatable with the rotation of the driven gear 11 can slant freely relative to the driven gear 11.

In the center of the keep plate 13, secured to the topside of the annular projection 11*b* of the driven gear 11, there is a hole 13*a* through which the drive shaft 12 is set with some play while between the drive shaft 12 and the driven gear 11 there is provided a compression spring 14.

The hole 13*a* is so dimensioned that the flange 12*b* cannot slip therethrough. A washer 15 is also provided. In this way the joint between the drive shaft 12 and the driven gear 11 constitutes a universal joint. The spring 14 pushes up the drive shaft 12 so that it is securely fitted to the rotary blade 7, thus ensuring a high shaving efficiency. A cover 16 has a hole 16*d* for accommodating the drive shaft 12. The cover is secured with screws, not shown, to the body, and serves to cover for the driving gear 10 and the driven gear 11. The cover 16 has on its topside around the center an annular projection 16*a*, the inside wall thereof forming a bore 16*b* which provides the space for the holder 8*a* of the screw 8. The annular projection 16*a* has in it a hole 16*c*, in which the retainer 17 is set so as to be freely slidable.

Between the retainer 17 and the cover 16 is mounted a compression spring 18. The retainer 17 is provided with a push button 19 connected thereto which partially protrudes through the hole 2*a* of the body 2. In this case the retainer 17 is made of a head steel.

The retainer 17 also has a hole 17*a* which communicates with the hole 16*a* when it is displaced against the repulsive force of the spring 18 by pushing the push button 19.

Figure 2:
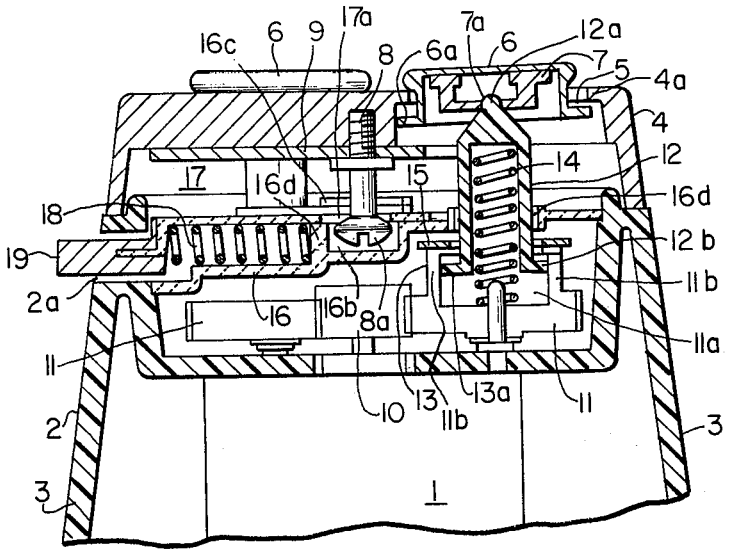
FIG. 2 is a sectional view of a portion of the shaver.

As shown in FIG. 2, the rim of the hole 17*a* is in engagement with the head 8*a* of the screw 8 when the retainer 17 is in its normal position. At this time the holder 4 is thus secured to the body 3. When the retainer 17 is displaced against the repulsive force of the spring 18 by pushing the push button 19, the holder 4 is disengaged from the body 3. When this shaver is used with the switch 20 turned on, the shear plates 6, 6, 6 are allowed to rock with the supporting projections 9*a* as fulcra so as to fit the curved skin surface, the rocking amplitude being largest where it is nearest to the center of the head 4.

The rotary blades 7, 7, 7 follow this rocking motion of the shear plate 6, 6, 6 and are driven by the drive shaft 12 which is allowed to slant accordingly relative to the driven gear.

Figure 3:
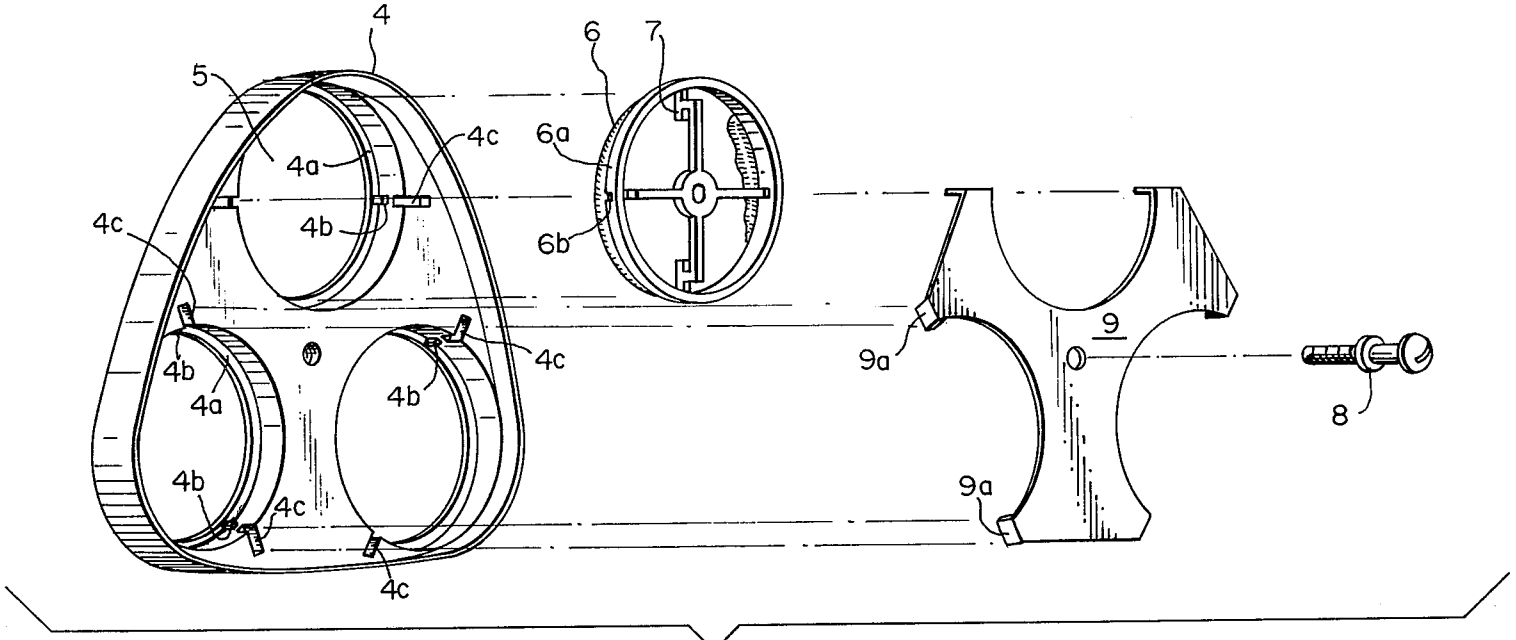
FIG. 3 is a perspective view of the assembly for supporting the shear plate on the holder of the case, with the assembly disassembled and viewed from the bottom.
Figure 4:
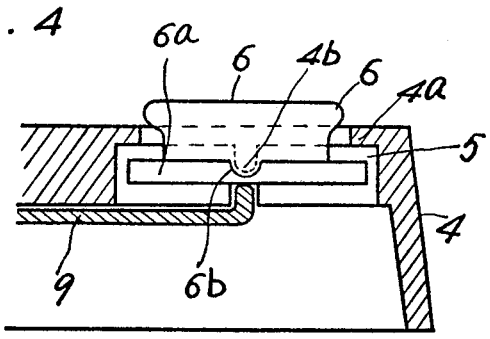
FIG. 4 is a diagram illustrating the mechanism for supporting the shear plate on the holder.

Referring now to FIG. 5 is another embodiment of the present invention, especially the shear plate supporting mechanism thereof. The shear plate 106 has a pair of recesses 106*c*, 106*c* which are adapted to match a pair of projections 109*a*, 109*a* of the supporting member 109 so that the supporting projections 109*a* can fit in the recesses 106*c* respectively. The fitting junctures, which serve as fulcra for the rocking of the shear plate 106, also prevent rotation of the shear plate 106. The recess 6*b* of FIG. 3 receiving the projection 4 of the holder 4 on the upper side of the flange 6 can then be dispensed with.

The supporting projections 109*a*, 109*a* are so positioned that the vertical amplitude of the rocking motion of the shear plate is maximum at a point nearest to or remotest from the center of the holder 104, i.e., they are so positioned as to support the shear plate 106 where symmetric across the center thereof and equidistant from the center of the holder 104.

When with either of the two embodiments the supporting member is made of an elastic material, the supporting member can flex according to the external force the shear plate is subjected to, thus allowing the shear plate to slant freely. In such a case it is also possible to dispense with the projection 104*b*.

Described below is still another embodiment with reference to FIG. 6. In this embodiment the supporting member 209 rotatably supports the ring 220 by two supporting projections 221, 221 and the ring 220, in turn, supports the shear plate 206, again rotatably by pins 222, 222 which are positioned apart from the supporting points with an angle of 90°. Thus, the supporting projection is inserted into a hole 206 and the pin is inserted in a hole 220*a* of the ring. In a similar manner, the supporting projections 221, 221 are so positioned that the vertical amplitude of the rocking motion of the shear plate is maximum at a point nearest to or remotest from the center of the holder 104.

The supporting mechanism allows the shear plate 206 to slant in any direction according to the external force to which it is subjected. In any of the embodiments of the present invention described above, the shear plate is supported on the case in such a manner that it can slant freely so as to fit the curved skin surface and thus a high shaving efficiency is ensured.

It is to be understood that the embodiments described above are not to be interpreted in a limiting amount and that further variations are possible on the basis of the principle of the present invention set forth herein.

I claim:

1. A dry shaver comprising a casing including a holder provided with at least one opening in the head thereof, a shear plate suspended to be tiltable with respect to the direction perpendicular to the central longitudinal axis of the casing, a rotary blade operatively associated with said shear plate, a driving means, and a drive shaft for coupling the rotary blade to the driving means, said rotary blade being fixed to a drive shaft with no play therebetween, and a compression spring provided between the driving means and the drive shaft for forcing the rotary blade to the shear plate, thereby making the compression force of the compression spring against the rotary blade and thus the shear plate parallel to the driving shaft and perpendicular to the shear plate at all times, said drive shaft being supported at the lower end thereof in a manner to be universally tiltable with respect to the direction parallel to the central longitudinal axis of the casing.

2. The dry shaver of claim 1, wherein a pair of supporting means for the shear plate is disposed on both sides of the shear plate to serve as a pair of fulcra therefor.

3. The dry shaver of claim 2, wherein the supporting means has two edges which serve as fulcrum and the shear plate is mounted on the edges thereof, thereby permitting the shear plate to slant.

4. The dry shaver of claim 3, wherein the shear plate has two recesses adapted to receive the respective edges of the supporting means so that when each edge is fitted in the respective recess the shear plate is prevented from rotating in union with the rotary blade.

5. The dry shaver of claim 1, comprising a plurality of openings provided in the holder with a shear plate tiltably disposed within each of said openings.

6. The dry shaver of claim 5, further including a plurality of retaining means for preventing the respective shear plate from slipping out through the respective opening.

7. The dry shaver of claim 6, wherein a rotary blade is rotatably associated with each of said shear plates.

8. The dry shaver of claim 7, wherein a pair of supporting means for the shear plate is disposed on both sides of the shear plate to serve as a pair of fulcra therefor, said supporting means being so arranged that the amplitude of the rocking motion of each shear plate is a maximum at a point nearest to or remotest from the center of the holder.

9. The dry shaver of claim 8, wherein the supporting means are substantially on a straight line perpendicular to a plane containing the center of the shear plate and the center of the holder.

10. The dry shaver of claim 2, wherein fitting junctures are provided between the supporting means and the holder, each fitting juncture composed of a projection on the supporting means and a recess on the holder, said recess adapted to receive the projection and thus serve as a positioning means.

11. The dry shaver of claim 2, wherein fitting junctures are provided between the supporting means and the holder, each fitting juncture composed of a projection on the holder and a recess on the supporting means, said recess adapted to receive the projection and thus serve as a positioning means.

12. The dry shaver of claim 2, wherein a projection is provided on either the shear plate or the supporting means and a corresponding hole for rotatably receiving said projection is provided on either the shear plate or the supporting means.

13. The dry shaver of claim 1, wherein a hole is provided in the leg portion of the rotary blade and a tip is provided at the upper end of the driving shaft, the diameter of the hole being substantially the same as that of the tip for joining the rotary blade with the driving shaft.

14. The dry shaver of claim 1, wherein a driving gear is associated with the driving means, said driving gear containing an aperture adapted to receive the driving shaft, said aperture being slightly larger than the peripheral surface of the driving shaft.

15. The dry shaver of claim 14, wherein the driving shaft is provided at its base with a flange, the aperture in said driving gear being slightly larger than the peripheral surface of said flange.

16. The dry shaver of claim 1, wherein a cover is provided for separating the driving means from the head of the shaver and a retainer which extends to the outside of the shaver is slidably disposed above said cover, the space defined by said retainer and said cover housing the compression spring so that when the retainer is displaced against the repulsive force of the spring, the head of the shaver is disengaged from the body of the shaver.

17. A dry shaver comprising:

(a) a shaver housing including a shaving head having at least one opening therein, (b) a shear plate disposed within said opening and adapted for tilting relative thereto and with the edge of said opening forming a fixed outer stop therefor, said shear plate including a cylindrical wall, (c) a floating rotary cutting element disposed within said shear plate and tiltably supporting the latter, (d) a rigid fixed inner shear plate stop member removably secured in said head, (e) and cooperative interlocking means on said shear plate and on said fixed stop member to prevent shear plate rotation at any tilted position thereof during rotation of said cutting member, said interlocking means comprising:

(1) recess means comprising at least one notch formed in said cylindrical wall, (2) and a fixed projection formed in said rigid stop member and disposed within said notch.

18. The shaver of claim 17 in which said fixed projection comprises a post of fixed length disposed within said notch throughout the full range floating shear plate positions.

19. The shaver of claim 18 in which:

(a) said stop member includes an inner transverse planular portion from which said post extends, and (b) the length of said post is such that, upon inward floating shear plate movement, said post will bottom within said notch and constitute the inner stop for said shear plate.

* * * * *